US007023457B2

(12) United States Patent
Huang et al.

(10) Patent No.: US 7,023,457 B2
(45) Date of Patent: Apr. 4, 2006

(54) SYSTEM AND METHOD FOR INTENSITY CONTROL OF A PIXEL

(75) Inventors: Samson X. Huang, Saratoga, CA (US); Ralph M. Kling, Sunnyvale, CA (US)

(73) Assignee: Intel Corporation, Santa Clara, CA (US)

( * ) Notice: Subject to any disclaimer, the term of this patent is extended or adjusted under 35 U.S.C. 154(b) by 741 days.

(21) Appl. No.: 09/805,755

(22) Filed: Mar. 13, 2001

(65) Prior Publication Data

US 2002/0130883 A1 Sep. 19, 2002

(51) Int. Cl.
*G09G 5/10* (2006.01)

(52) U.S. Cl. ..... 345/690; 345/89

(58) Field of Classification Search ..... 345/63, 345/77, 87–89, 690–696; 349/84, 85
See application file for complete search history.

(56) References Cited

U.S. PATENT DOCUMENTS

| | | | | |
|---|---|---|---|---|
| 3,845,243 | A | 10/1974 | Schmersal et al. | |
| 4,531,160 | A * | 7/1985 | Ehn | 348/798 |
| 5,124,695 | A | 6/1992 | Green | |
| 5,341,153 | A * | 8/1994 | Benzschawel et al. | 345/694 |
| 5,619,224 | A * | 4/1997 | Hoshino et al. | 345/98 |
| 5,654,732 | A * | 8/1997 | Katakura | 345/95 |
| 5,745,089 | A | 4/1998 | Taguchi et al. | |
| 5,805,136 | A | 9/1998 | Silverbrook et al. | |
| 5,861,869 | A | 1/1999 | Scheffer et al. | |
| 5,905,482 | A * | 5/1999 | Hughes et al. | 345/89 |
| 6,016,133 | A * | 1/2000 | Nito et al. | 345/89 |
| 6,094,187 | A * | 7/2000 | Jones et al. | 345/690 |
| 6,094,243 | A | 7/2000 | Yasunishi | |
| 6,144,364 | A | 11/2000 | Otobe et al. | |
| 6,232,943 | B1 * | 5/2001 | Tagawa et al. | 345/97 |
| 6,271,820 | B1 * | 8/2001 | Bock et al. | 345/97 |
| 6,417,864 | B1 * | 7/2002 | Jones et al. | 345/596 |
| 6,417,868 | B1 * | 7/2002 | Bock et al. | 345/698 |
| 6,445,489 | B1 * | 9/2002 | Jacobson et al. | 359/296 |
| 6,583,791 | B1 * | 6/2003 | Berryman et al. | 345/589 |

FOREIGN PATENT DOCUMENTS

| | | |
|---|---|---|
| EP | 0685832 A1 | 12/1995 |
| EP | 0714085 A1 | 5/1996 |
| EP | 0848369 A2 | 6/1998 |
| EP | 1091342 A2 | 4/2001 |
| JP | 05100630 | 4/1993 |

* cited by examiner

*Primary Examiner*—Amr A. Awad
*Assistant Examiner*—Tom Sheng
(74) *Attorney, Agent, or Firm*—Paul E. Steiner

(57) ABSTRACT

An LCOS chip may have a pixel divided into an outer subpixel and an inner subpixel. A driver may independently drive the subpixels. The driving technique may be pulse-width modulation. Because of the pixel is divided into subpixels, pulses of short widths that drive an undivided pixel may be replaced with pulses of longer duration. In an alternative embodiment, the pixel is not divided into sub-pixels. The driving technique may be a combination of pulse width and pulse height modulation. The waveform may replace pulses of short widths with pulses of longer duration and reduced voltage levels.

14 Claims, 4 Drawing Sheets

SYSTEM AND METHOD FOR INTENSITY CONTROL OF A PIXEL

BACKGROUND

1. Field

The subject matter described herein relates generally to the field of display devices and, more particularly, to a system and method for intensity control of a pixel.

2. Background

To achieve a gray scale of 256 levels between black and white, a pixel may be driven by 256 different pulse widths between a 0 to 100 percent duty cycle, or by 256 different voltage levels. Similarly, color displays, for example, those that use a red, green, and blue dot per pixel, have each dot energized to different intensities, creating a range of colors perceived as a mixture of these colors.

The resolution of short pulse widths and small voltage steps may be difficult to achieve due to liquid crystal and circuit constraints.

DESCRIPTION OF DRAWINGS

Like reference symbols in the various drawings indicate like elements.

DETAILED DESCRIPTION

A system and method for intensity control of a pixel is disclosed. The system and method may increase gray-scale resolution of liquid-crystal-on-semiconductor (LCOS) displays. Gray scale as used herein refers to gray scale systems and color systems. Tones as used herein refers to the intensity of the pixel.

Figure 1:
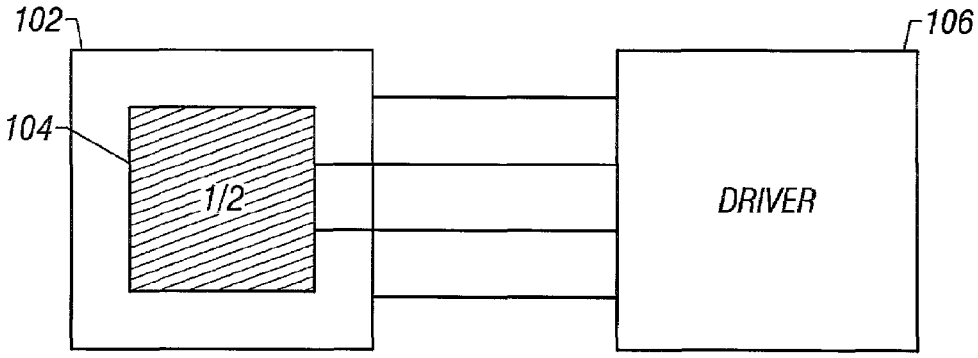
FIG. 1 is a diagram of a particular system for intensity control of a pixel.

FIG. 1 is a diagram of a particular system for intensity control of a pixel. An LCOS chip may have a pixel divided into an outer subpixel 102 and an inner subpixel 104. The size of the subpixels may be, for example, 10 microns or less. The subpixels may be adjusted to compensate for fringing effects, for example, the subpixels may be concentric. In the particular design shown in FIG. 1, the light output ratio of the subpixels may be about 1:1. The subpixel area may be about one-half of the area of an undivided pixel that uses a typical pulse-width modulated signal.

A driver 106 may independently drive the subpixels. The driver technique may use pulse-width modulation. Because the pixel is divided into subpixels longer pulses may be used as driving pulses. These may be longer than the pulses that would otherwise drive an undivided pixel. These longer pulses may provide for a pulse shape that is within the liquid crystal and circuit constraints.

Figure 2:
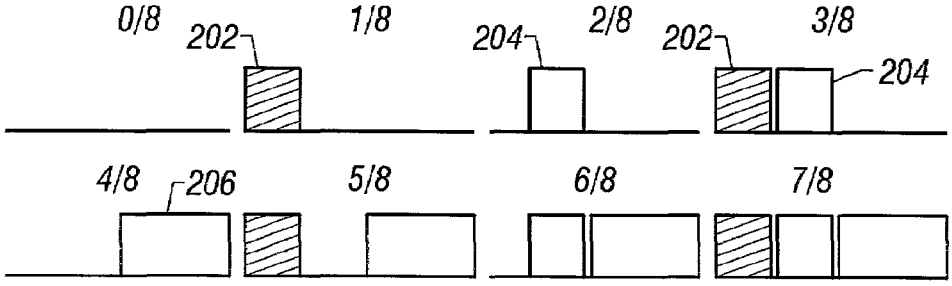
FIG. 2 is a diagram of one embodiment of waveforms driving the pixel shown in FIG. 1.

FIG. 2 is a diagram of one embodiment of waveforms driving the pixel shown in FIG. 1. The figure illustrates a three-bit example that provides a gray scale with eight tones ($=2^3$). The two subpixels collectively provide one spatial bit (s=1), but the waveform provides two pulse widths or electrical bits (e=2). Shaded pulses may be applied to the inner subpixel, and unshaded pulses may be applied to both the inner subpixel and the outer subpixel.

The least-significant pulse width, shown as the shaded first pulse 202, and the next-to-the-least-significant pulse width 204 may be about the same width, for example, two-eighths (2/8). This width is about twice the width of the least-significant pulse width (1/8) of a typical pulse-width modulated signal that drives an undivided pixel. The most-significant pulse width 206 in this example is about twice the width of the other two pulses.

The first pulse 202 may be applied to one of the subpixels, for example, the inner pixel 104. The one-half area (1/2) of the inner subpixel and the two-eighths width (2/8) of the first pulse may result in a one-eighth (1/8) gray-scale tone.

The second pulse 204 may be applied to the inner subpixel 104 and the outer subpixel 102 to produce a two-eighths (2/8) gray-scale tone. The first pulse 202 may be applied to the inner subpixel and the second pulse 204 may be applied to the inner subpixel and the outer subpixel to produce a three-eighths (3/8) gray-scale tone. The third pulse 206 having a four-eighths (4/8) width may be applied to the inner subpixel and the outer subpixel to produce a four-eighths gray-scale tone. The production of the remainder of the gray-scale tones is analogous, and shown in FIG. 2.

This system may be scaled up to produce $2^N$ gray-scale tones, where N can be a positive integer number, using analogous techniques.

Figure 3:
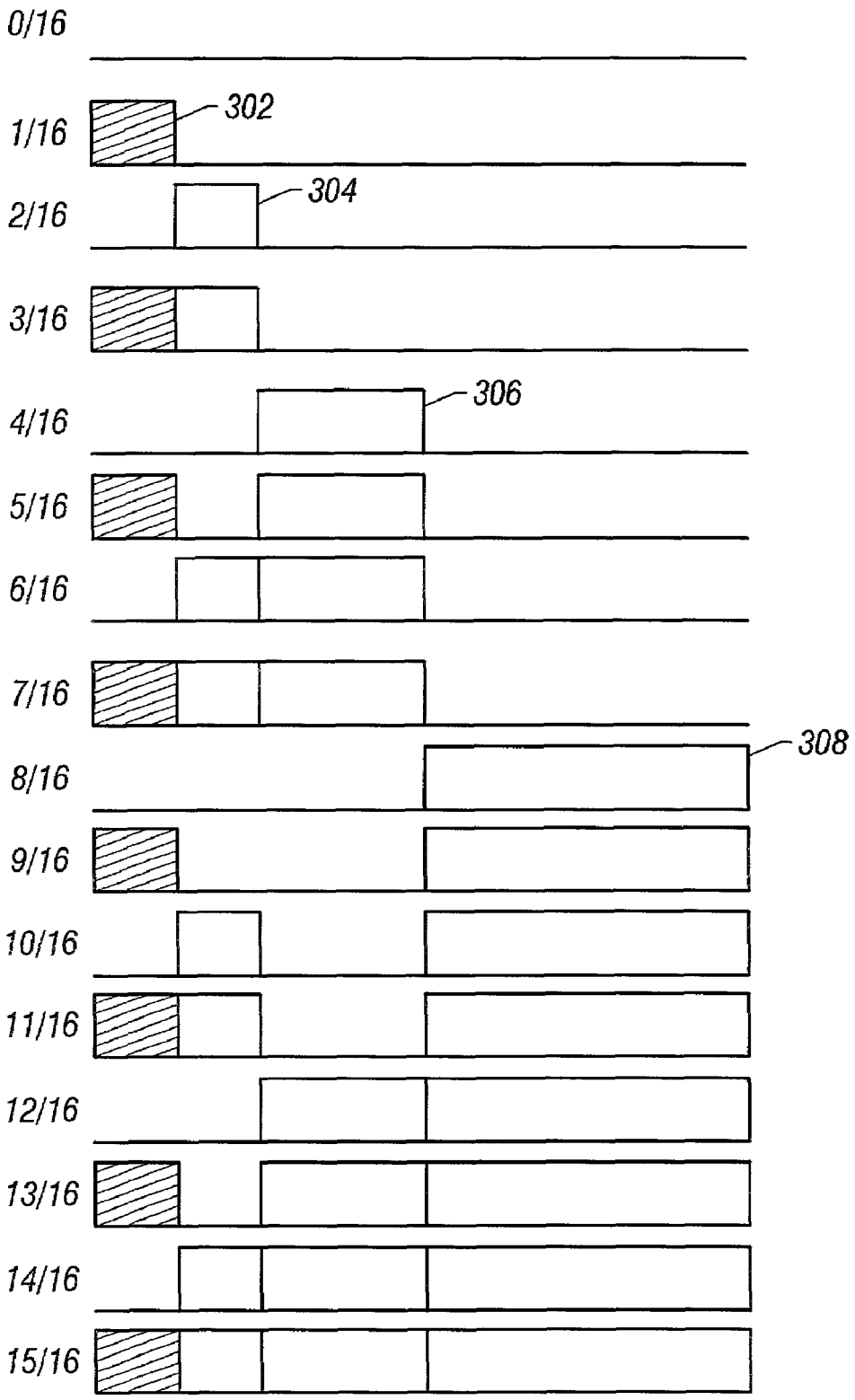
FIG. 3 is a diagram of an alternative embodiment of waveforms driving the pixel shown in FIG. 1.

FIG. 3 is a diagram of an alternative embodiment of waveforms driving the pixel shown in FIG. 1. The figure illustrates a four-bit example that provides sixteen ($2^4$) gray-scale tones. The two subpixels provide one spatial bit (s=1). The waveform provides three pulse widths (e=3). Shaded pulses may be applied to the inner subpixel, and unshaded pulses may be applied to both the inner subpixel and the outer subpixel.

The least-significant pulse width, shown as the shaded first pulse 302, and the next-to-the-least-significant pulse width 304, are about the same width, for example, one-eighth (1/8). These pulses can be applied to the subpixels in a similar manner as described with reference to FIG. 2 to produce the 1/16, 2/16, and 3/16 gray-scale tones.

A third pulse 306 may be about twice the width (2/8) of the first pulse 302 and the second pulse 304. The third pulse may be applied to the inner subpixel 104 and the outer subpixel 102 to produce a four-sixteenths (4/16) gray-scale tone.

A fourth pulse 308 may be about four times the width (4/8) of the first pulse and the second pulse. The fourth pulse may be applied to the inner subpixel 104 and the outer subpixel 102 to produce an eight-sixteenths (8/16) gray-scale tone.

The production of the remaining gray-scale tones is analogous, and shown in FIG. 3.

Increasing the number of spatial bits may increase the width of the least-significant pulse width. For example, four subpixels may represent 2 spatial bits. The four subpixels may have a light output ratio of 1:1 and be concentric, for example, one within another. The modulated waveform may have N-s pulses of different pulse widths combined to provide $2^N$ gray-scale tones, and the least-significant pulse width and the next-to-the-least-significant pulse width would each have a width of $2^s/2^N$.

Figure 4:
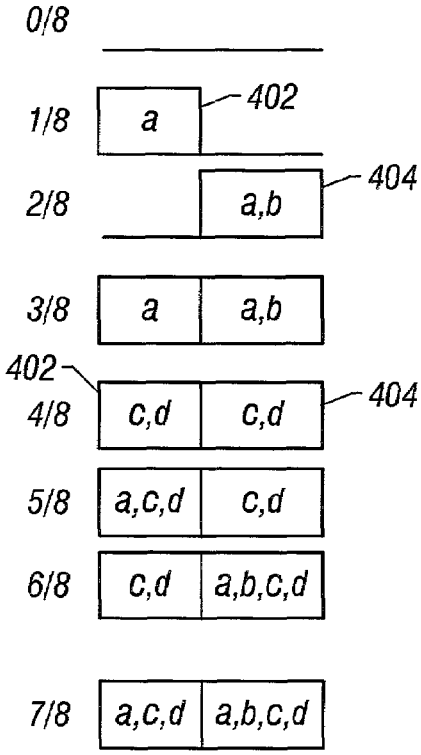
FIG. 4 is a diagram of another alternative embodiment of waveforms for driving a pixel.

FIG. 4 is a diagram of an alternative embodiment of waveforms driving a pixel having two spatial bits (s=2). The figure illustrates a three-bit example that provides an eight-tone ($2^3$) gray scale. The pixel may have four subpixels. The four subpixels, a, b, c, and d may be concentric with "a" as the innermost subpixel. The subpixels may have a light output ratio of about 1:1:1:1 or an area of about one-quarter (¼) of the area of an undivided pixel. The letters a, b, c, and d within the pulses shown in FIG. 4 represent the subpixels to which the pulses are applied. The least-significant pulse width 402 and the next-to-the-least-significant pulse width 404 may each have a width of one-half ($2^2/8$). The first three gray-scale tones are produced similarly as described with reference to FIG. 2.

The four-eighths (⅝) tone may be produced by applying the first pulse 402 and the second pulse 404 to the outermost subpixels "c" and "d." The production of the remainder of the tones is analogous, and shown in FIG. 4.

A skilled artisan will recognize that subpixels "c" and "d" may be combined into one subpixel having twice the light output ratio of the innermost subpixel.

Figure 5:
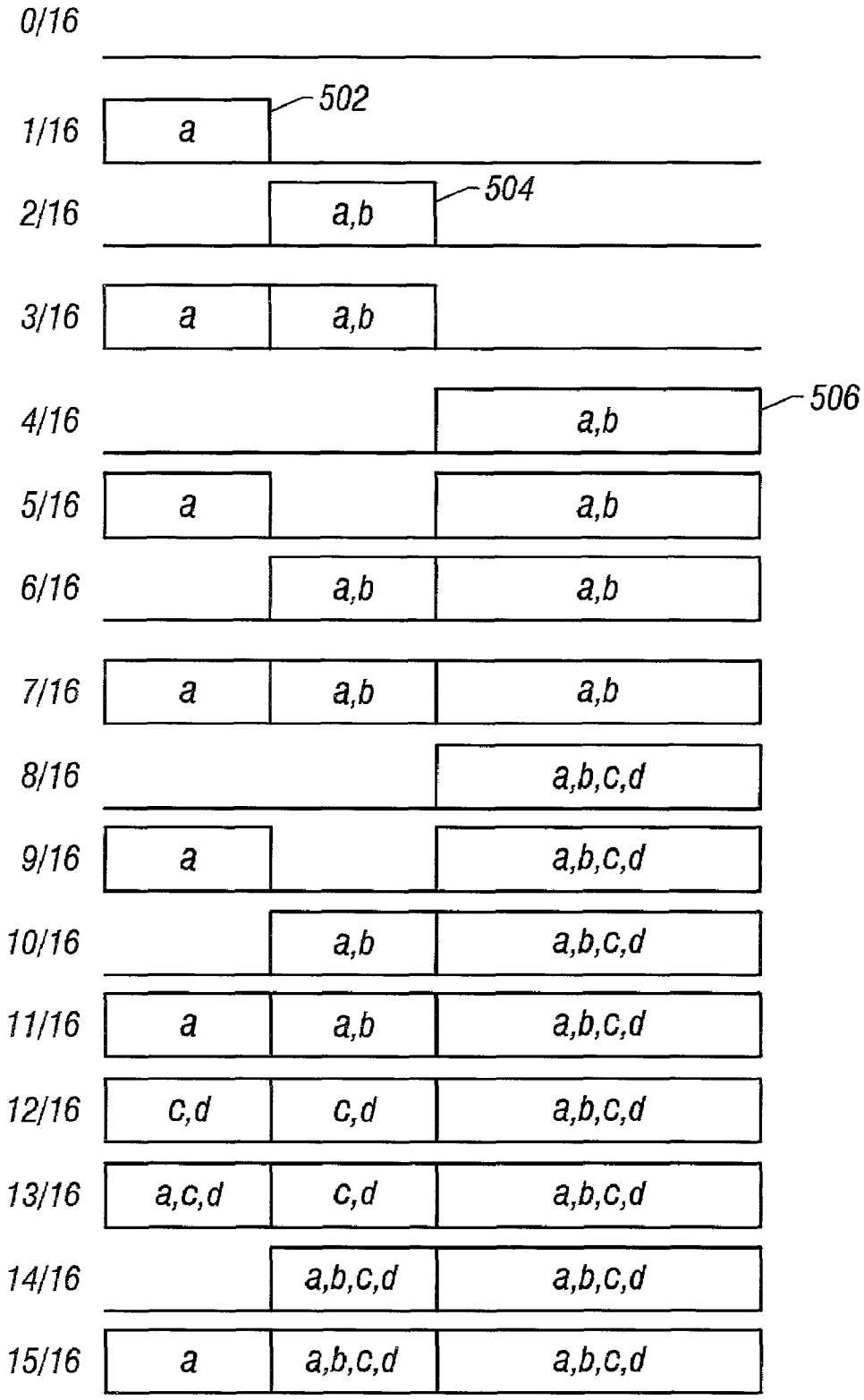
FIG. 5 is a diagram of another alternative embodiment of waveforms for driving a pixel.

FIG. 5 is a diagram of another alternative embodiment of waveforms for driving a pixel having two spatial bits (s=2). Two pulse widths (e=2) may produce sixteen gray-scale Lones.

The least-significant pulse width, shown as the shaded first pulse 502, and the next-to-the-least-significant pulse width 504, are about the same width, for example, one-fourth (¼). These pulses can be applied to the subpixels in a similar manner as described with reference to FIG. 4 to produce the 1/16, 2/16, and 3/16 gray-scale tones.

The four-sixteenths (4/16) tone may be produced by applying a third pulse 506 to the subpixels "a" and "b." The eight-sixteenths (8/16) tone may be produced by applying the third pulse 506 to all four subpixels. The production of the remainder of the tones is evident from FIG. 5.

Figure 6:
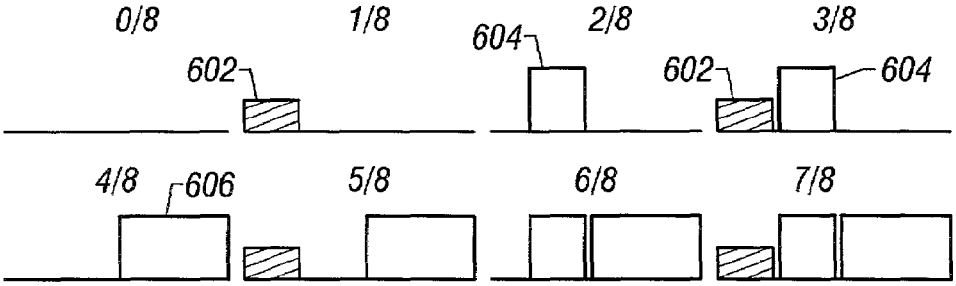
FIG. 6 is a diagram of another alternative embodiment of waveforms for driving a pixel.

FIG. 6 is a diagram of another alternative embodiment of waveforms for driving a pixel. The pixel in this system is not divided into subpixels. The figure illustrates a three-bit example that provides an eight-tone gray scale ($2^3$). The waveform is a combination of pulse-width and pulse-height modulation in that it provides two pulse widths and two voltage levels (e=3). The waveform may replace pulses of short widths with pulses of longer duration and reduced voltage levels.

The least-significant pulse width, shown as the shaded first pulse 602, and the next-to-the-least-significant pulse width 604 may be about the same width. This pulse width is about twice the width (⅜) of the least-significant pulse width of a typical pulse-width modulated signal (⅛). The least-significant pulse, however, may be of unequal amplitude compared to the second pulse, for example, about half the amplitude of the second pulse. The most-significant pulse width 606 example may be about twice the width of the other two pulses and about the same amplitude as the second pulse.

The first pulse 602 may be applied to the pixel to produce a first gray-scale tone (⅛) and the second pulse 604 may be applied to the pixel to produce a second gray-scale tone (⅜). The first pulse and the second pulse may be applied to the pixel to produce a third gray-scale tone (⅜). The third pulse 606 may be applied to the pixel to produce a fourth gray-scale tone (⅝). The production of the remainder of the tones is analogous, as shown in FIG. 6.

A number of embodiments of the invention have been described. Nevertheless, it may be understood that various modifications may be made without departing from the spirit and scope of the invention. Accordingly, other embodiments are within the scope of the following claims.

What is claimed is:

1. A system for intensity control of a pixel having $2^N$ gray-scale tones, comprising:

a pixel having $2^s$ subpixels, two of the subpixels with the lowest light output having a light output ratio of about 1:1; and a driver to apply a pulse-width modulated waveform to the subpixels, the modulated waveform having N-s pulses of different pulse widths combined to provide the $2^N$ gray-scale tones, where N is a positive integer and s is a positive integer having a value less than N.

2. The system of claim 1, the least-significant pulse width and the next-to-the-least-significant pulse width each have a width of $2^s/2^N$.

3. The system of claim 2, the least-significant pulse width being applied to a one of the two subpixels with the lowest light output to obtain a first gray-scale tone.

4. The system of claim 2, the next-to-the-least-significant pulse width being applied to the two subpixels with the lowest light output to obtain a second gray-scale tone.

5. The system of claim 2, the least-significant pulse width being applied to a one of the two subpixels with the lowest light output and the next-to-the-least-significant pulse width being applied to the two subpixels with the lowest light output to obtain a third gray-scale tone.

6. The system of claim 1, the $2^s$ subpixels being concentric.

7. A system for intensity control of a pixel, comprising:

a first subpixel;

a second subpixel, the first subpixel and the second subpixel having a light output ratio of substantially 1:1; and a driver to apply a pulse-width modulated electrical waveform to the first subpixel and the second subpixel, the modulated waveform having a first pulse and a second pulse, the first pulse being applied to the first subpixel and the second pulse being applied to the first subpixel and the second subpixel, wherein the first pulse and the second pulse being of about equal width.

8. The system of claim 7, the modulated waveform having a third pulse being substantially twice the width of the first pulse, the third pulse being applied to the first subpixel and the second subpixel.

9. The system of claim 7, the first pulse and second pulse being of unequal amplitude.

10. The system of claim 7, the first subpixel and the second subpixel being concentric.

11. A method of intensity control of a pixel, comprising:

applying a first electrical pulse with a first width to a first subpixel of the pixel to produce a first gray-scale tone; and applying a second electrical pulse with the first width to the first subpixel and a second subpixel of the pixel to produce a second gray-scale tone, wherein the first subpixel and the second subpixel have a light output ratio of substantially 1:1.

12. The method of claim 11 further comprising applying the first pulse to the first subpixel and the second pulse to the first subpixel and the second subpixel to produce a third gray-scale tone.

13. The method of claim 11 further comprising applying a third electrical pulse with a second width substantially twice the first width to the first subpixel and the second subpixel to produce a fourth gray-scale tone.

14. The method of claim 11 further comprising applying the first pulse to the first subpixel and a third electrical pulse with a second width substantially twice the first width to the first subpixel and the second subpixel to produce a fifth gray-scale tone.

* * * * *